US005690749A

United States Patent [19]

Lee

[11] Patent Number: 5,690,749

[45] Date of Patent: Nov. 25, 1997

[54] METHOD FOR REMOVING SUB-MICRON PARTICLES FROM A SEMICONDUCTOR WAFER SURFACE BY EXPOSING THE WAFER SURFACE TO CLEAN ROOM ADHESIVE TAPE MATERIAL

[75] Inventor: Chii-Chang Lee, Austin, Tex.

[73] Assignee: Motorola, Inc., Schaumburg, Ill.

[21] Appl. No.: 617,015

[22] Filed: Mar. 18, 1996

[51] Int. Cl.[6] ..... B08B 7/04

[52] U.S. Cl. ..... 134/6; 134/26; 134/42

[58] Field of Search ..... 134/4, 6, 7, 9, 134/26, 42

[56] References Cited

U.S. PATENT DOCUMENTS

| | | | |
|---|---|---|---|
| 3,080,263 | 3/1963 | Conrose | 134/6 |
| 3,717,897 | 2/1973 | Amos et al. | 134/6 X |
| 3,754,991 | 8/1973 | Amos et al. | 134/4 |
| 4,156,619 | 5/1979 | Griesshammer | 134/26 |
| 5,320,706 | 6/1994 | Blackwell | 134/33 X |

FOREIGN PATENT DOCUMENTS

| | | | |
|---|---|---|---|
| 6-232108 | 8/1994 | Japan | H01L 21/304 |
| 7-094563 | 4/1995 | Japan | H01L 21/66 |

*Primary Examiner*—Robert J. Warden
*Assistant Examiner*—Saeed Chaudhry
*Attorney, Agent, or Firm*—Keith E. Witek

[57] ABSTRACT

A method for removing particles (21–24) begins by providing a substrate (10). The substrate (10) contains one or more integrated circuit layers (12) having a top surface (12A). The particles (21–24) are in contact with top surface (12A). A tape (14) comprising an adhesion layer (16) and a carrier film (18) is applied to the surface (12A) such that the adhesion layer (16) is in contact with the particles (21–24). The tape (14) is then removed from the surface (12A) wherein the adhesion layer (16) is able to remove the particles (21–24) from the surface (12A) of the substrate (10). The tape (14) can be applied to a front or active surface of a semiconductor wafer, where the surface either has a topography containing high areas (37) and low areas (39) or has a planarized surface (12A) in order to reduce a total number of particles (21–24) on the surface (12A).

22 Claims, 3 Drawing Sheets

METHOD FOR REMOVING SUB-MICRON PARTICLES FROM A SEMICONDUCTOR WAFER SURFACE BY EXPOSING THE WAFER SURFACE TO CLEAN ROOM ADHESIVE TAPE MATERIAL

FIELD OF THE INVENTION

The present invention relates to semiconductor processing in general, and more specifically to removing residues and particles from a surface of a semiconductor wafer.

BACKGROUND OF THE INVENTION

As geometries of integrated circuit devices decrease, and integration levels increase in number, the generation and removal of particles on a semiconductor wafer becomes a more important issue to improve integrated circuit yield. Particles which are generated through various steps in the manufacturing process, for example, during etch steps or polishing steps, must be removed from the wafer to avoid defects and reliability problems.

Conventional removal of particles from semiconductor wafers comes in a variety for forms. One of the most common cleaning or particle removal process is the use of a spin-rinse-dry (SRD) process. In an SRD process, a wafer is sprayed with fluid (for example, in water or alcohol) while being spun. A combination of dynamic forces caused by the spinning, and fluid drag forces are used to pull the particles from the wafer surface. Following the rinse, the wafers are dried by spinning. While SRD has wide spread use in semiconductor manufacturing, a disadvantage of the technique is that as the radius of the particles to be removed becomes smaller, the effectiveness of the removal or cleaning process is reduced. The dynamic force removal of particles is proportional to the cube of the radius of the particles, while the fluid drag forces used to remove particles is proportional to the radius squared. Therefore, for small sub-micron particles, SRD is an incomplete solution to particle removal.

Other particle removal techniques have similar limitations. For example, ultrasonic cleaning is an immersion cleaning process whereby instead of spinning or rotating the wafer, the wafers are placed in a liquid bath where the liquid within the bath is ultrasonically vibrated. Again, however, forces used to remove particles from the wafer diminish with decreasing particle radius, as is the case for SRD cleaning.

Another known technique for particle removal is one which relies upon differential surface energy of two fluids. For example, a combination of fluids (for example, isopropyl alcohol and water) are combined in a bath. The wafer is dipped in this bath, and as particles on the wafer reach an interface between the two fluids in the bath, the differences in surface tension between the two fluids and the particles causes the particles to be lifted or pulled from the wafer. A problem with this technique is that a limited number of solutions are available for use in achieving the differential surface energies, and the forces created by the these limited fluids are not sufficient to remove a significant amount of particulates from the wafer surface.

Further disadvantages with each of the above techniques described relates to the ability to manufacture semiconductor devices in a timely and cost effective manner. Many of the prior art cleaning techniques are single wafer techniques which require on the order of minutes to perform. Further, these techniques typically involve chemicals which must not only be purchased but must somehow be disposed of in large quantifies. Therefore, it would be advantageous to have a particle removal process for semiconductor wafers which effectively removes even small particles, while at the same time can be implemented in a manufacturing environment with minimal processing time, minimal chemical waste, and with minimal equipment or supply cost.

DETAILED DESCRIPTION OF A PREFERRED EMBODIMENT

Generally, the present invention involves applying tape to a semiconductor wafer in order to reduce a number of particles on a top surface (also referred to as an active surface) of the wafer. In a preferred form, a semiconductor wafer is provided which has a top surface which contains a plurality of particles. This semiconductor wafer is placed on a vacuum chuck and brought into contact with tape material. The tape has a carrier film and an adhesion layer. The adhesion layer portion of the tape is placed face down onto the wafer so that glue molecules in the adhesion layer will adhere to the particles on a top surface of the wafer. The tape is then removed from the surface of the wafer whereby the particles on a top surface of the wafer are removed due to the adhesion between the particles and the adhesion layer of the tape.

Figure 1:
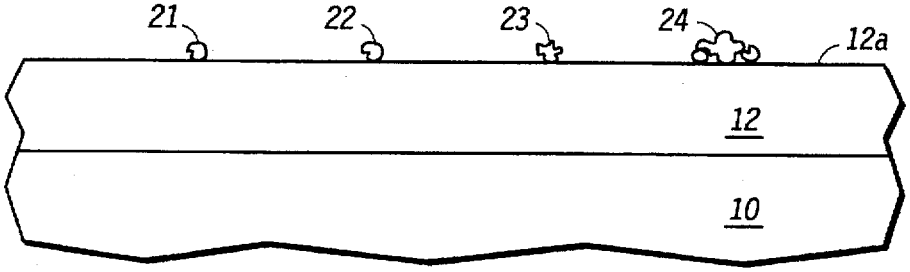
FIGS. 1–3 illustrate in partial cross-sectional view a planar surface of a semiconductor wafer having particles which are removed by an adhesive tape in accordance with one embodiment of the present invention.

The present invention will be further understood with reference to FIGS. 1–8. FIG. 1 illustrates a substrate 10. The substrate 10 may be single crystalline silicon, gallium arsenide, silicone-on-insulator material, epitaxial formations, germanium, germanium silicon, polysilicon, and/or like substrate materials used in semiconductor manufacturing. In a preferred form, substrate 10 is a silicon semiconductor wafer. Within the substrate 10, there may be formed diffusion regions for source and drain electrodes of MOS transistors, well regions, bipolar transistor electrodes, and any other doped region which allows for the formation of active circuitry within the substrate 10. One or more integrated circuit layers 12 are formed overlying the substrate 10. The one or more integrated circuit layers 12 may include dielectric layers. For example, these dielectric layers may include, wet or dry silicon dioxide, silicon nitride, nitride materials, tetraethylorthosilicate (TEOS) based oxide, borophosphosilicate glass (BPSG), phosphosilicate glass (PSG), oxide-nitride-oxide (ONO) films, oxynitride, or a like dielectric materials. In addition, the one or more integrated circuit layers 12 may contain conductive regions. These conductive regions may include polysilicon, silicide or salicide regions, metallic regions, refractory metals, or like conductive materials used for integrated circuit fabrication. Layers 12 are deposited, patterned, and etched to form active circuitry overlying the substrate 10. The details of forming layers 12 are not important to gain an understanding of the invention. It is important to note, however, that the present invention may be utilized at any point in time and on any material surface during wafer processing.

In FIG. 1, a top layer with the one or more integrated circuit layer 12 is chemically mechanically polished using a slurry to form a top polished surface 12A. When performing a chemical mechanical polishing (CMP) operation, residue and particulates such as particles 21, 22, 23, and 24 (hereafter particles 21–24) are left on the polished surface 12A as illustrated in FIG. 1. These particles 21–24 may be particles from the layer which is polished, abrasive particles from the polishing slurry, particles from the ambient, particles from the CMP tool, or any other contaminants. If these particles 21–24 remain on the surface and are not removed by subsequent processing, then integrated circuit yield will be reduced. Therefore, a need exists for a cost effective and efficient method for removal of the particles 21–24.

Figure 2:
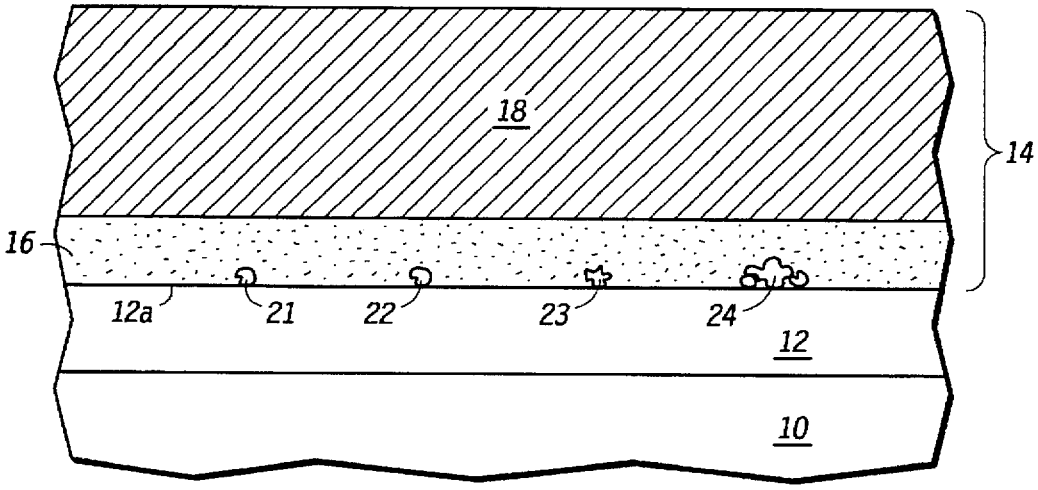

FIG. 2 illustrates that a tape 14 is applied to the polished surface 12A in order to remove the particles 21–24. Tape 14 comprises an adhesion layer 16 and a carrier film 18. In one form, tape 14 can be cleanroom tape publicly available from the Advanced Laminated Material Applications (ALMA), Inc. When using this cleanroom tape, the carrier film 18 is a polyolefin film and the adhesion layer 16 is an acrylic based adhesive. Another tape which can be used is available from Label Graphics, Inc. and is referred to as tape P3WTCLG18. This tape comprises a carrier film made of polypropylene and an adhesive layer made from LG18 adhesive. In another form, LG19 adhesive may also be used. It is important to note that other corporations such as 3M, provide alternative tapes to those listed herein which can also be suitably used to remove particles in accordance with the invention.

Generally, in a preferred form, the tape used as tape 14 in FIG. 2 should have certain characteristics. First, the tape should be compatible with a cleanroom environment. Second, the adhesive layer of the tape should adequately adhere to particles on the surface of a wafer. Third, it is preferable that the adhesive layer 16 has a greater adhesive force with the carrier 18 than with the layers 12. If the adhesive layer 16 has greater adhesive force to the carrier 18 than to the layers 12, then adhesive residue remaining on the wafer after the tape 14 is removed from the substrate is reduced. Fourth, it is desirable to use a tape wherein the adhesive force between glue molecules in the adhesive layer 16 is greater than an adhesive force between the glue molecules and the particles 21–24 and the wafer surface 12A. This will also ensure that glue residue remaining on the wafer is minimized when the wafer and the tape are separated. It is important to note that any glue residue remaining on the surface 12A after removal of the tape can be dissolved by exposing the surface 12A to a solvent, such as acetone, alcohol, or other organic solvent.

Therefore, in summary, FIG. 2 illustrates that a tape 14 containing an adhesive layer 16 is brought into contact with the surface 12A. The adhesive layer 16 adheres to the particles 21–24 as illustrated in FIG. 2.

Figure 3:
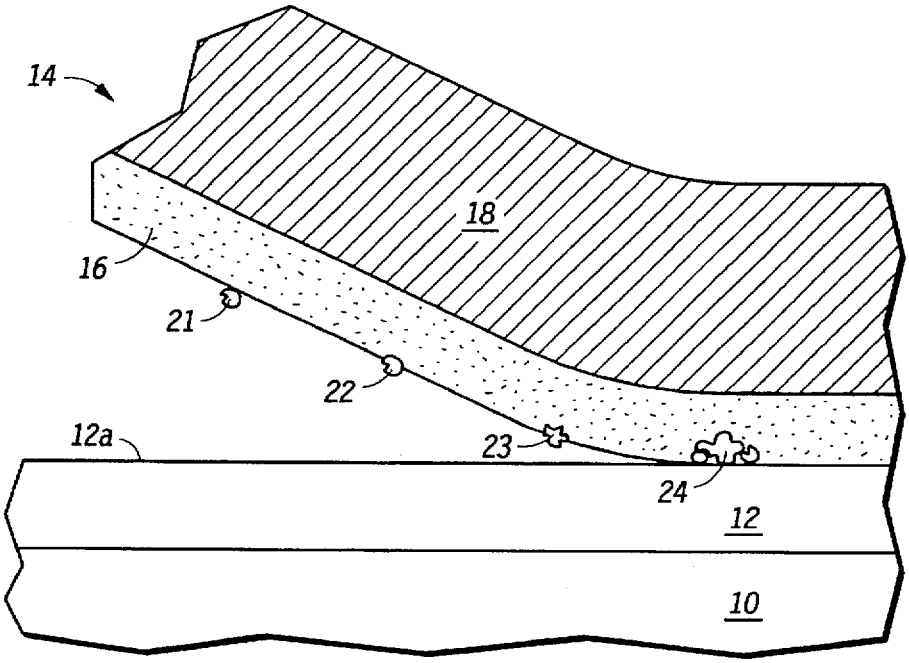

FIG. 3 illustrates that the tape 14 is removed from the surface 12A. This removal process will result in the particles 21–24 being removed from the surface 12A via adhesion to the adhesion layer 16 as illustrated in FIG. 3. Therefore, a total number of particle resident on the surface 12A of the substrate 10 are effectively and efficiently removed from the surface 12A to increase yield of an integrated circuit. As previously discussed, the removal of the tape 14 may or may not result in a glue residue remaining on the surface 12A. This residue may easily be removed by exposing the surface 12A to a solvent to remove this residue effectively. Therefore, FIGS. 1–3 illustrate a method by which particulates are removed from a top surface 12A which has been chemically mechanically polished using tape 14.

Figure 4:
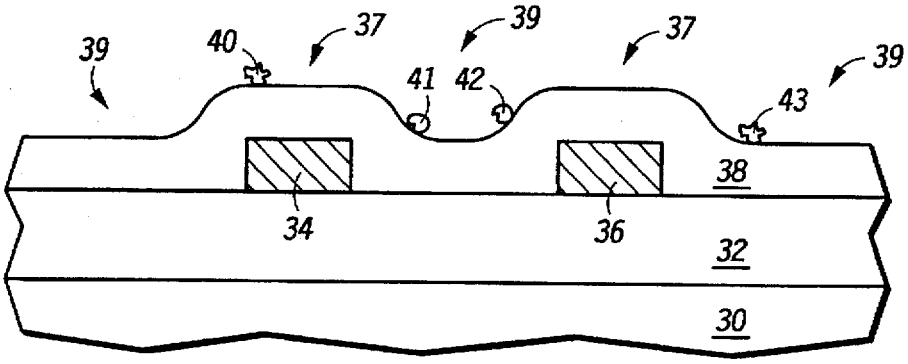

FIGS. 4–7 illustrate that the tape method described and illustrated in reference to FIGS. 1–3 can also be used for removing particles from a non-planar topography surface. FIG. 4 illustrates a substrate 30 which is similar to the substrate 10 of FIG. 1. One or more integrated circuit layers 32, comparable to layers 12, are illustrated in FIG. 4, wherein a top layer of layers 32 is an interlevel dielectric layer. Below the interlevel dielectric layer, there may be formed a plurality of conductive and dielectric layers to form active devices overlying the substrate 30. Conductive interconnects 34 and 36 are formed overlying the layers 32 using conventional lithographic and etch processing. Overlying the conductive interconnects 34 and 36 is formed a dielectric layer 38. Dielectric layer 38 is a conformal dielectric layer which forms high areas 37 overlying the conductive interconnects 34 and 36 and low areas 39 as illustrated in FIG. 4. FIG. 4 also illustrates a plurality of particles 40, 41, 42, and 43 (hereafter particles 40–43), wherein some of the particles reside on top of high areas 37 and other particles reside in low areas 39.

Figure 5:
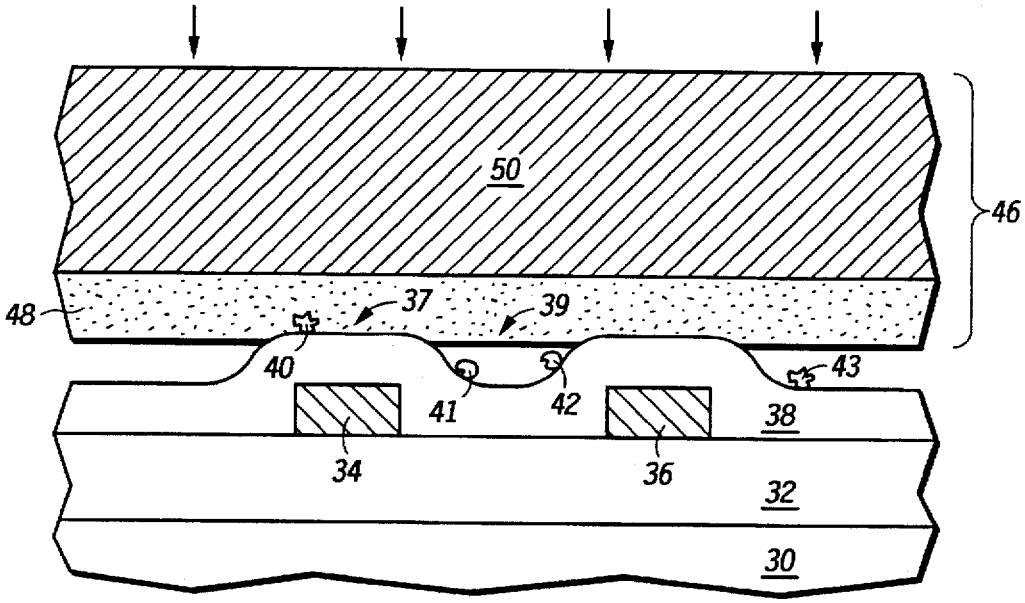

FIG. 5 illustrates that a tape 46 is brought into contact with the dielectric layer 38. If a minimal amount of force is applied to the tape 46, then the tape 46, which comprises an adhesion layer 48 and a carrier film 50, will only come in contact with the high areas 37. Therefore, when using minimal force, the particles 41, 42, and 43 residing in the low areas 39 will not come into contact with the adhesion layer 48 and remain on a surface of the dielectric layer 38. To solve this issue and enable removal of particles in the low areas 39, a tape 46 may be used which has an adhesion layer 48 with a thickness "X" where X is greater than a difference in height between the high areas 37 and low areas 39. For example, an adhesive layer thickness of about 1 mil (25 μm) is sufficient. Thus, the thickness of the adhesive layer will be great enough to ensure that pressure applied to the tape 46 will result in adhesive material coming in contact with the entire surface of the layer 38, as demonstrate in FIG. 6.

Figure 6:
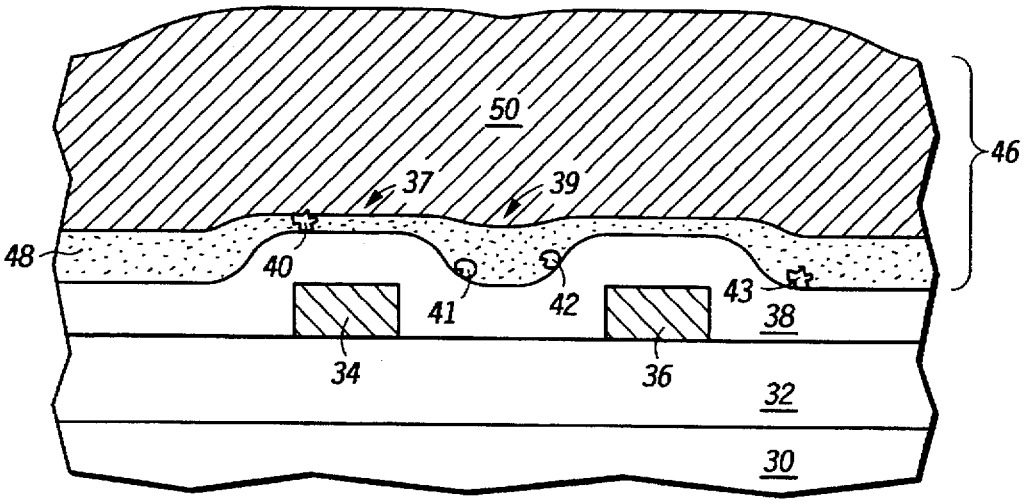

FIG. 6 illustrates that positive force can be applied to the tape 46 so that material of the adhesive layer will deform from the high areas 37 to low areas 39. Consequently, the glue molecules of the adhesive layer 48 will come into contact with particles 40–43 in both the high surfaces 37 and the low surfaces 39 of the dielectric layer 38.

Figure 7:
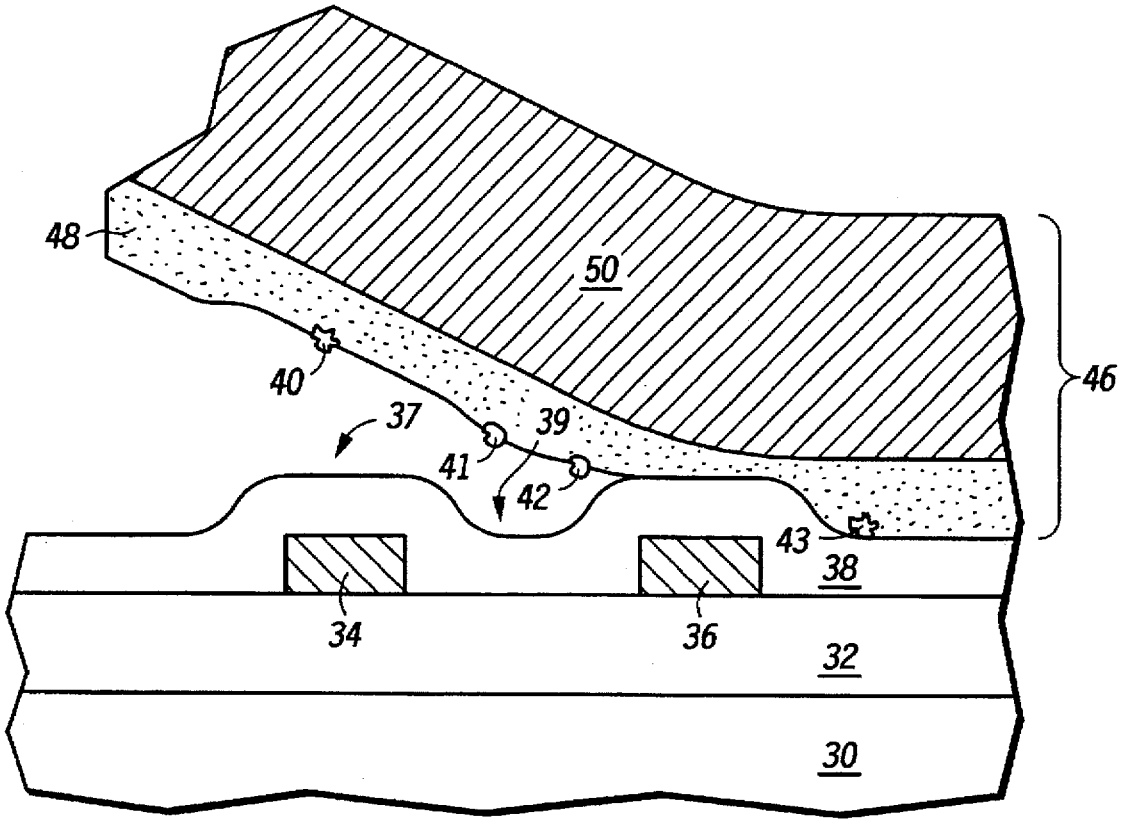
FIGS. 4–7 illustrate, in partial cross-sectional view, another embodiment of the present invention wherein particles can be removed from a non-planar surface of a semiconductor wafer using an adhesive tape in accordance with the present invention.

As illustrated in FIG. 7, the tape 46 is then removed from the surface of the layer 38 whereby the particles 40–43 are effectively removed from both the high areas 37 and the low areas 39. As mentioned previously, if any adhesive residue remains on the surface of the substrate upon removing the tape, such residue can be dissolved using a solvent.

Figure 8:
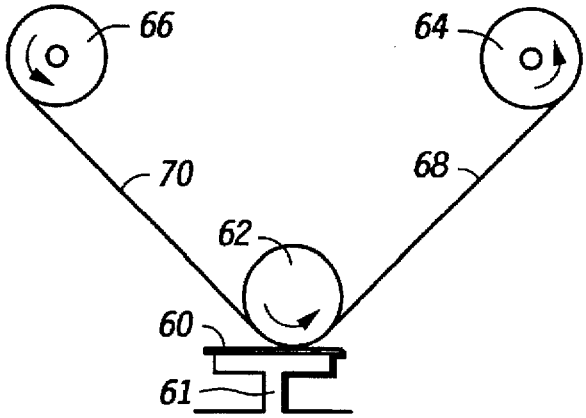
FIG. 8 illustrates in cross-section a schematic view of a roller system suitable for applying and removing tape to a semiconductor wafer in accordance with the present invention.

FIG. 8 illustrates an apparatus which can be used to apply tape to a semiconductor wafer in accordance with the present invention. FIG. 8 illustrates a vacuum chuck 61 which is used to hold a wafer 60 in place. Tape is provided from a feed reel 66 to a tape application roller 62. Therefore, feed reel 66 provides new tape 70 to the tape application roller 62 for application to the wafer 60. The wafer 60 is moved laterally beneath the surface of the roller, or the roller is moved laterally across the surface of the wafer, so that new tape 70 is brought into contact with the top surface of the wafer 60 with sufficient pressure. The wafer or roller continue lateral movement, thereby causing the tape to be peeled or released from the wafer surface. As a result of removing the tape, particles from the surface of the wafer 60 are removed. The particles will attach to the adhesive layer of the tape 68, and this used tape 68 will be collected by a take-up reel 64 for proper disposal or reclamation. Therefore, FIG. 8 illustrates a tape providing apparatus for effectively removing particles from the surface of the semiconductor wafer 60.

From the foregoing, it is apparent that the present invention provides a simple method for effectively removing particles from a surface of a semiconductor wafer. Particles and residue may be effectively removed from either a topographic surface or a planar surface of a semiconductor wafer by bringing the semiconductor surface in contact with an adhesive tape. The tape is an inexpensive and effective way for removing particles, including sub-micron particles, from a surface of a wafer whereby chemical waste is reduced, throughput is increased, and yield is enhanced.

While the present invention has been illustrated and described with reference to specific embodiments, further modifications and improvements will occur to those skill in the art. For example, any type of tape which is compatible with the cleanroom environment may be used to remove particles as taught herein. The tape removal process taught herein can be run in a batch process to remove particles from a plurality of wafers in a simultaneous fashion. The particle removal process taught herein can be used at any stage during the manufacture of a semiconductor wafer. The particle removal process as taught herein can also be used on other objects such as components within a deposition chamber, wafer clamps, electrodes, or the like to effectively remove particles from semiconductor equipment components. It is to be understood, therefore, that this invention is not limited to the particular forms illustrated and that is intended in the appended claims to cover all modifications that do not depart from the spirit and scope of this invention.

I claim:

1. A method for removing particles from an surface of a wafer on which integrated circuitry is formed, the method comprising the steps of:

providing the wafer having the surface wherein the surface of the wafer is in contact with the particles, the particles having a dimension which is sub-micron;

applying a tape which comprises a carrier film and an adhesion layer to the surface of the wafer such that the adhesion layer adheres to the particles, the tape being clean room tape which can be used in a clean room environment where wafers are manufactured;

removing the tape from the surface of the wafer with at least some particles still adhered to the adhesion layer to reduce a total number of particles on the surface of the wafer; and exposing the wafer to an organic solvent solution to remove any adhesive material which may have remained on the wafer after exposure to the adhesion layer of the tape.

2. The method of claim 1 wherein the step of providing the wafer comprises providing the wafer wherein the surface is a chemically mechanically polished surface.

3. The method of claim 2 further comprising the step of:

scrubbing the surface of the wafer to remove slurry residue from the chemically mechanically polished surface before applying the tape to the surface.

4. The method of claim 2 further comprising the step of:

polishing a dielectric layer to create the surface.

5. The method of claim 2 further comprising the step of:

polishing a conductive layer to create the surface.

6. The method of claim 1 wherein the step of exposing further comprises:

exposing the surface of the wafer to either an alcohol solvent or a acetone solvent after the step of removing the tape to remove any adhesion layer residue from the surface of the wafer.

7. The method of claim 1 wherein the step of applying the tape further comprises applying the tape wherein the adhesion layer of the tape adheres to the carrier film of the tape with a first adhesion force and the adhesion layer adheres to the particles with a second adhesion force wherein the first adhesion force is greater than the second adhesion force.

8. The method of claim 1 wherein the step of applying the tape further comprises applying the tape wherein the adhesion layer of the tape contains a plurality of glue molecules where the plurality of glue molecules adhere to each other with a first adhesion force and the plurality of glue molecules adhere to the particles with a second adhesion force wherein the first adhesion force is greater than the second adhesion force.

9. The method of claim 1 wherein the step of providing the wafer comprises providing the wafer wherein the surface has a topography such that the surface has high areas and low areas, and wherein the step of applying comprises:

applying the tape with a force where the force is great enough to remove particles from both the low areas and the high areas of the surface of the wafer.

10. The method of claim 9 wherein the step of applying the tape with a force comprises rolling the tape onto the surface of the wafer and causing the adhesion layer of the tape to deform into a plurality of low areas of the surface.

11. A method for removing particles from a semiconductor wafer comprising the steps of:

providing a semiconductor wafer having an active side and a layer formed on the active side, the layer having a surface and particles on the surface, the particles being sub-micron in size;

providing a tape for removing the particles from the surface, the tape comprising a carrier film made of polyolifin material and an adhesive layer made of an acrylic-based adhesive adhered to the carrier film;

pressing the tape against the semiconductor wafer such that the adhesive layer of the tape comes into contact with the particles on the surface;

peeling the tape off the semiconductor wafer such that the particles remain affixed to the adhesive layer of the tape and are removed from the wafer; and rinsing the semiconductor wafer with an organic solvent solution to remove any adhesive material which may have remained on the semiconductor wafer after exposure to the adhesion layer of the tape.

12. The method of claim 11 wherein the step of providing a semiconductor wafer comprises providing a semiconductor wafer wherein the surface of the layer is substantially planar.

13. The method of claim 11 further comprising the steps of planarizing the active side of the semiconductor wafer using a polishing operation, prior to the step of pressing the tape.

14. The method of claim 13 wherein the step of planarizing comprises applying a slurry to the semiconductor wafer, wherein the slurry comprises abrasive particles.

15. The method of claim 14 wherein the step of providing a semiconductor wafer comprises providing a semiconductor wafer wherein the particles to be removed are abrasive particles remaining from the polishing operation.

16. The method of claim 14 further comprising the steps of rinsing and drying the semiconductor wafer after the polishing operation and before the step of pressing the tape.

17. The method of claim 11 wherein the step of rinsing the semiconductor wafer comprises rinsing the semiconductor wafer with an alcohol or acetone solvent, after the step of peeling, to removing any residue left on the semiconductor wafer due to exposure to the adhesive layer of the tape.

18. The method of claim 11 wherein the step of pressing a tape comprises pressing the tape against the semiconductor wafer using a roller.

19. The method of claim 18 wherein the step of providing a tape comprises providing the tape on a feed reel and further comprising the step of taking up used tape on a take-up reel.

20. The method of claim 11 wherein the step of providing a semiconductor wafer comprises providing a semiconductor wafer wherein the surface has a topography having high areas and low areas, and wherein there is a difference in height between the high areas and the low areas, and wherein the adhesive layer of the tape has a thickness which is greater than the difference in height.

21. A method for removing particles from a semiconductor wafer comprising the steps of:

providing a semiconductor wafer;

depositing a layer of material onto the semiconductor wafer;

polishing a surface of the layer of material using a slurry to form a polished surface, the polishing leaving particles on the polished surface;

rinsing the semiconductor wafer after polishing;

drying the semiconductor wafer after rinsing;

applying tape to the polished surface after drying, wherein the tape comprises a carrier film and an adhesion layer, and wherein the tape is applied such that the adhesion layer is put into contact with the polished surface using a positive force, the adhesion layer adhering to the particles located on the polished surface, the tape being a cleanroom-compatible tape, wherein: (1) the adhesion layer, has greater adhesive force with the carrier film than with the polished surface; and (2) the adhesion layer contains glue molecules wherein adhesive forces between glue molecules is greater than the adhesive force between the glue molecules and the particles;

removing the tape from the polished surface to remove the particles from the polished surface, the particles being sub-micron in geometry; and rinsing the semiconductor wafer with an organic solvent solution to remove any adhesive material which may have remained on the semiconductor wafer after exposure to the adhesion layer of the tape.

22. The method of claim 21 wherein the step of rinsing further comprises:

exposing the polished surface to an alcohol solvent after the step of removing, the solvent removing any residual adhesive on the polished surface, where the residual adhesive is any adhesion from the adhesive layer which remains on the wafer after the step of removing.

* * * * *